US008869838B2

(12) United States Patent
Herlihy et al.

(10) Patent No.: US 8,869,838 B2
(45) Date of Patent: Oct. 28, 2014

(54) INSULATING PLUG FOR AIR CONDITIONING SLEEVES

(76) Inventors: Randall Herlihy, Croton-on-Hudson, NY (US); Robert Feuer, New Rochelle, NY (US); Paul Fiore, White Plains, NY (US); William Devito, Tuckahoe, NY (US)

( * ) Notice: Subject to any disclaimer, the term of this patent is extended or adjusted under 35 U.S.C. 154(b) by 245 days.

(21) Appl. No.: 13/158,509

(22) Filed: Jun. 13, 2011

(65) Prior Publication Data

US 2011/0303669 A1 Dec. 15, 2011

Related U.S. Application Data

(60) Provisional application No. 61/354,314, filed on Jun. 14, 2010.

(51) Int. Cl.

| | |
|---|---|
| ***B65D 6/10*** | (2006.01) |
| ***F24F 13/08*** | (2006.01) |
| ***F23J 13/08*** | (2006.01) |
| ***F24F 13/20*** | (2006.01) |

(52) U.S. Cl.

CPC ..... *F24F 13/082* (2013.01); *F23J 13/08* (2013.01); *F24F 13/20* (2013.01)

USPC ..... 138/89; 138/96 R; 454/358

(58) Field of Classification Search

CPC ..... F24F 13/082; F24F 13/20; F23J 13/08; E04F 19/08; E05B 65/006; E06B 9/02

USPC ..... 138/89, 90, 92, 94, 96 R; 454/358

See application file for complete search history.

(56) References Cited

U.S. PATENT DOCUMENTS

| | | | | |
|---|---|---|---|---|
| 1,710,439 | A * | 4/1929 | Orson | 138/90 |
| 3,877,357 | A * | 4/1975 | Felter et al. | 454/353 |
| 4,206,784 | A * | 6/1980 | Phillips | 138/92 |
| 4,576,522 | A * | 3/1986 | Freeman | 405/225 |
| 4,585,033 | A * | 4/1986 | Westman | 138/89 |
| 6,050,893 | A * | 4/2000 | Waite | 454/349 |
| 6,505,441 | B1 * | 1/2003 | Shuey et al. | 49/463 |
| 8,178,781 | B2 * | 5/2012 | Duffy | 174/70 C |

* cited by examiner

*Primary Examiner* — J. Casimer Jacyna
(74) *Attorney, Agent, or Firm* — Donald J. Ranft; Collen IP

(57) ABSTRACT

A novel device and method to thermally seal openings such as air conditioner sleeves, ducts and chimney is disclosed and claimed. The device includes insulating layer and gasket layers sandwiched in between outer shells.

14 Claims, 4 Drawing Sheets

INSULATING PLUG FOR AIR CONDITIONING SLEEVES

This application claims priority from Provisional Patent Application No. 61/354,314 filed Jun. 14, 2010.

TECHNICAL FIELD & BACKGROUND

This invention pertains generally to the field of accessories used with air conditioning equipment and particularly to products which cover or seal air conditioning sleeves.

Many room air conditioning units are mounted in openings in the outer walls of buildings referred to as air conditioning sleeves. When these air conditioning units are replaced a person simply slides the old unit out of the sleeve and slides the new unit back in. Where an air conditioning unit is absent from the sleeve the opening to the sleeve can be sealed in many ways. Typically the opening is closed off by fitting a metal cap over the ends of the sleeve on the interior and exterior sides of the sleeve.

In colder climates, the through the wall air conditioning units are often a major source of heat loss from a building structure during the cold winter months. Air conditioner units are not air tight and can allow cold outside air to migrate into the interior. Cold air can also blow through the gap between the sleeve interior and the ac unit resulting in a colder apartment and a loss of energy due to greater use of the heating equipment in the building. Even with the use of weatherization products such as caulk or foam strips air leakage gaps can still exist and no matter what material is used around the ac unit there is still heat loss that exists through the air conditioner itself. Apartment tenants have used pillows, roll plastic, garbage bags with duct tape, and material air conditioning covers that do very little to combat the heat loss problem. There are often air leeks with other products because the seal between the products used and the sleeve are generally not air-tight or air-sealed.

SUMMARY

A device and method to seal an air conditioning unit wall opening, commonly referred to as an air conditioner sleeve, when an air conditioning unit is removed. The insulation plug is easily inserted to provide a thermal barrier and allows the air conditioning unit to be reinserted if desired after the plug is installed.

DETAILED DESCRIPTION

Figure 1:
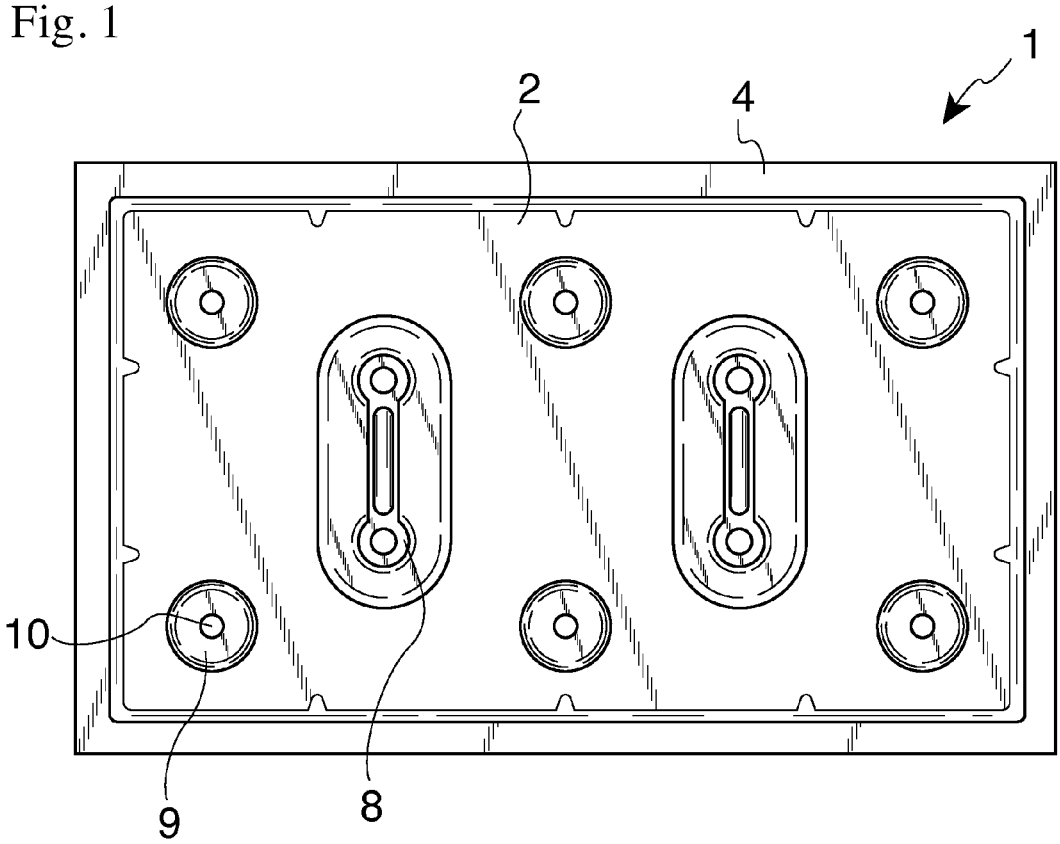
FIG. 1 depicts a front view of an insulating plug.
Figure 3:
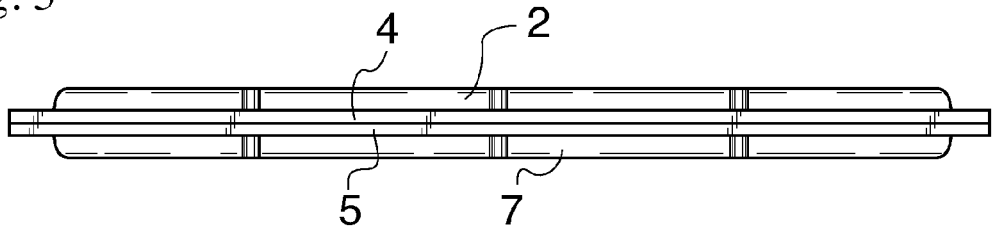
FIG. 3 depicts a top view of an insulating plug.
Figure 4:
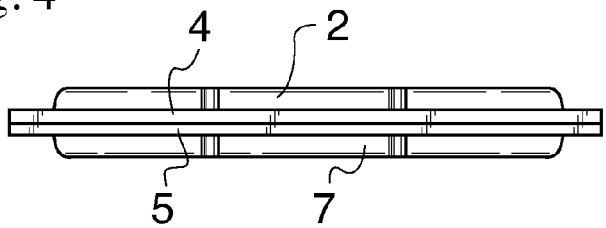
FIG. 4 depicts a side view of an insulating plug.

A front view of a typical insulating plug is shown on FIG. 1. As shown on FIG. 2 a typical insulating plug (1) includes 6 layers. The outer shells (2 and 7) are flat rectangular shape as shown on the drawings and preferably made of semi-rigid plastic which is vacuum formed and molded. Each exterior shell includes indentations (9) that allow fastening devices such as grommets and plungers (10) to be inserted for clamping the 6 layers together. Handles (8) on each outer shell are typically heat fused to the shells (2 and 7).

Figure 2:
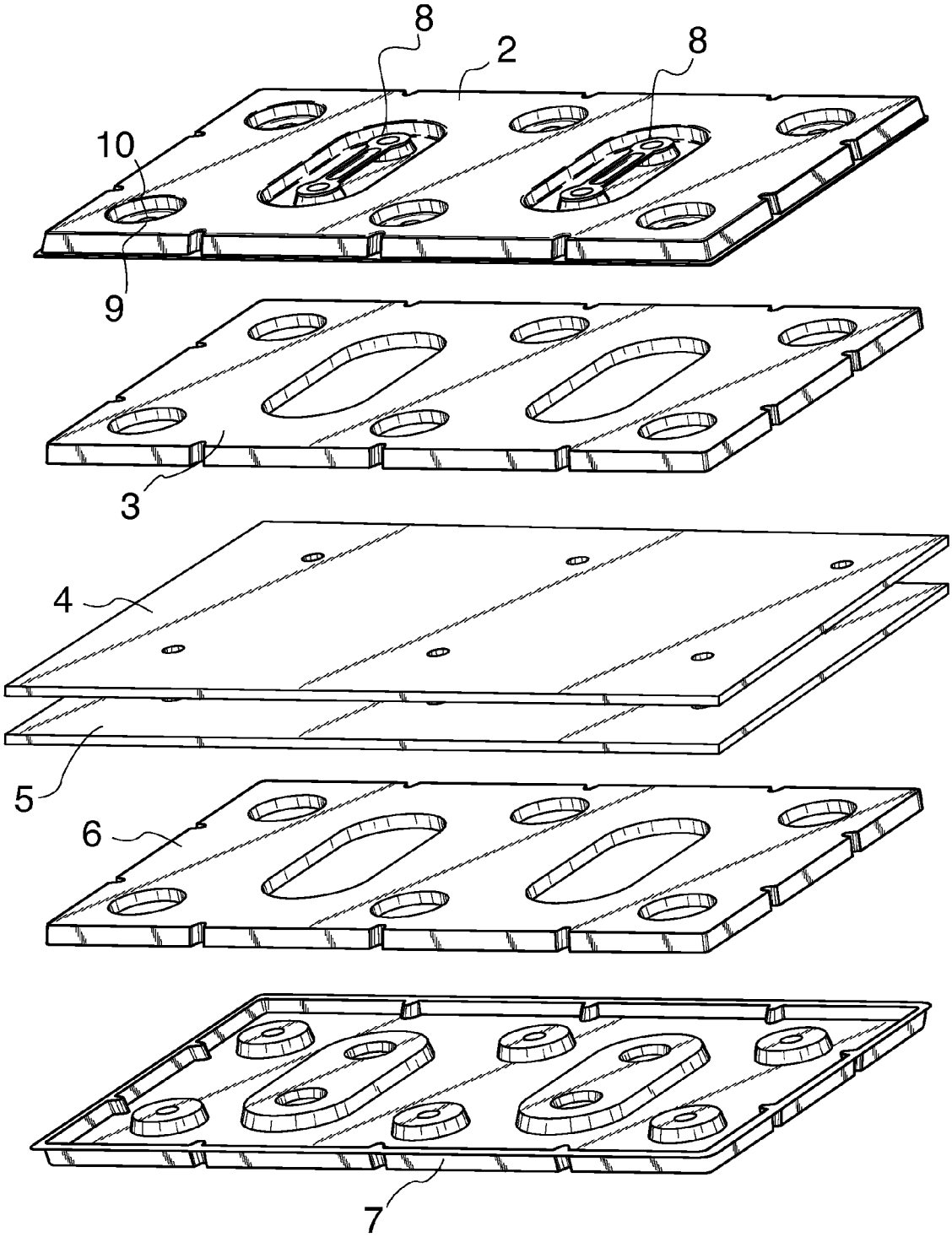
FIG. 2 depicts a typical insulating plug with 6 layers.
Figure 5:
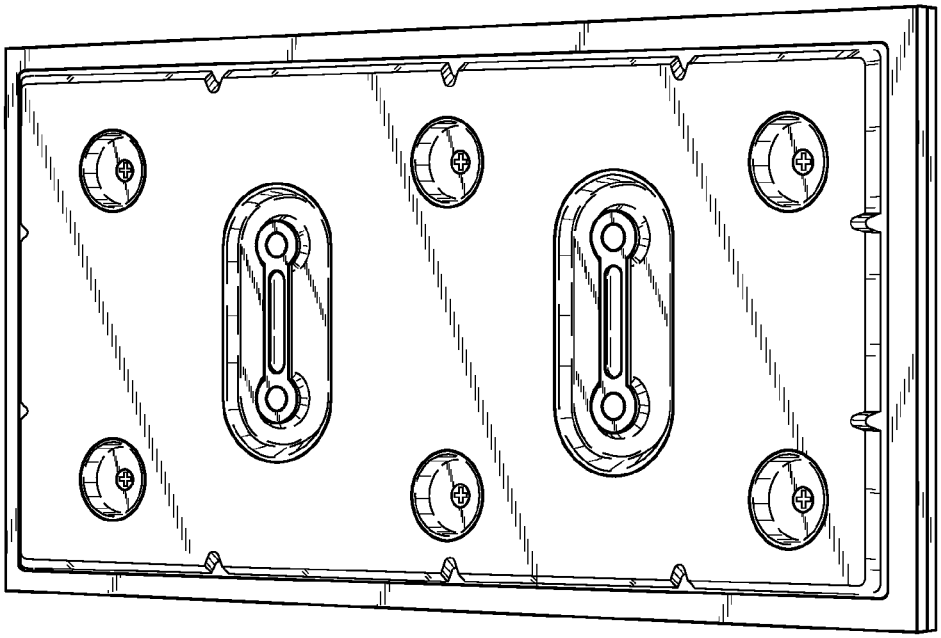
FIG. 5 depicts a perspective view of an insulating plug.

Insulating layers (3 and 6) such as foam are designed to fill the inside cavity in each of the outer shells (2 and 7). One or more gaskets (4 and 5) are located between the insulating layers (3 and 6) and outer shells (2 and 7). The insulating layers and gaskets are parallel to each other and to the outer shells, and extend across the entire surface of the outer shells. As shown on FIGS. 1-6, the gaskets (4 and 5) extend beyond the entire perimeter of the outer shells to allow flexibility ensuring contact with the surface of the air conditioning sleeve to minimize any possible leakage. The use of more than one gasket such as the 2 shown on FIG. 2 provides further assurance that there are no gaps between the air conditioning sleeve and the insulating plug.

The insulating plugs can be sized to fill any air conditioning sleeve. Typically adjusting the size of the gaskets (4 and 5) is sufficient to accommodate most sleeve sizes. But the entire insulating plug can be sized to properly seal a sleeve when increasing the size of only the gasket negatively impacts the performance of the seal to be created in a particular sized sleeve.

The insulating plug is designed to be easily installed and removed. The rigid plastic exterior shell makes the product easy to maneuver into the open sleeve space and the double gasket will shape to any imperfections that exist in the sleeve itself. Once installed the sleeve is air sealed and no air leakage exists between the outside and inside of the building. The product is designed so that the air conditioner can be placed back in the sleeve after installation. The product is then removed at the end of the winter season. If no air conditioner exists in the sleeve the product can be left in the sleeve indefinitely.

Figure 7:
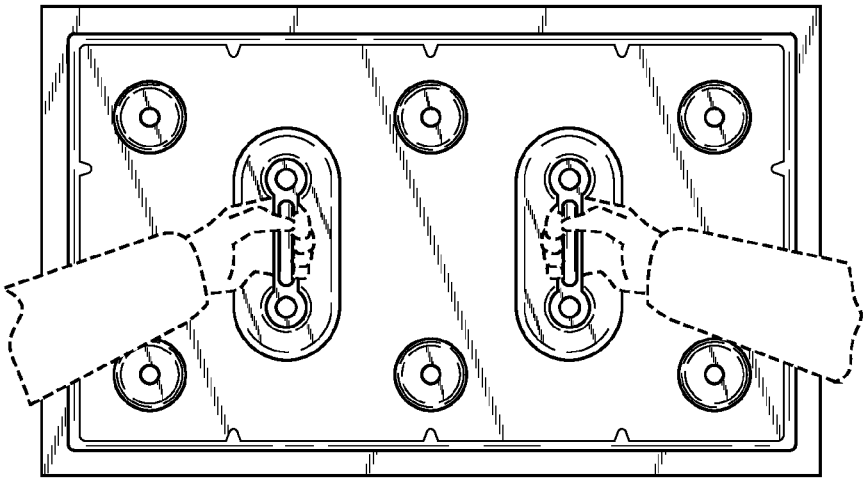
FIG. 7 depicts an insulating plug being positioned into final position in an air conditioner sleeve.
Figure 6:
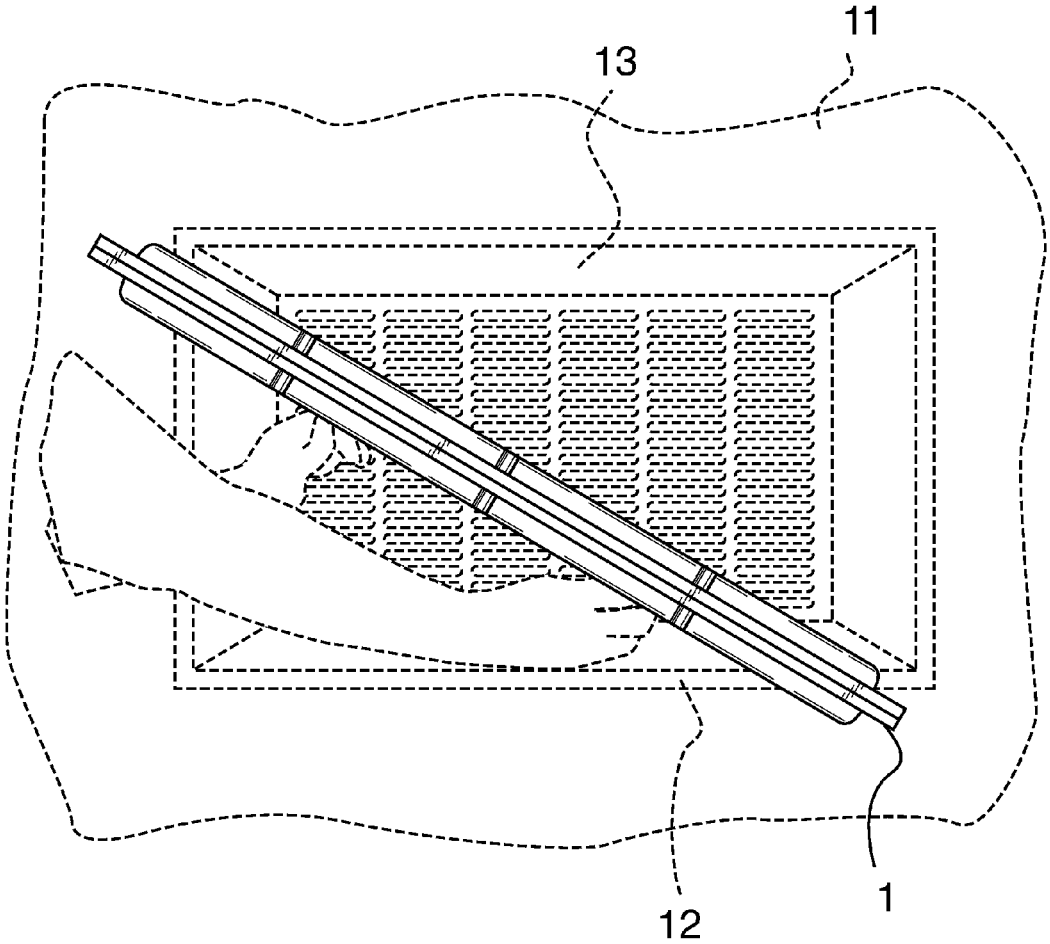
FIG. 6 depicts an insulating plug being inserted into an air conditioning sleeve.

Installing the product is done by tilting the product (1) on a diagonal from opposite corners of the sleeve (12) mounted in a wall (11) and placing the product (1) in the sleeve interior (13) as shown on FIG. 6. Once the product is placed in the sleeve it is straightened to be completely adjacent to the back of the sleeve and pushed into place until the entire product is flush against the back of the sleeve and the double gasket has formed a tight seal around the entire perimeter of the sleeve's back wall (FIG. 7). The seal can be improved by running one's finger around the gasket to smooth out any small air gaps that may be visible. This results in a tight seal that prevents any cold air from leaking through the sleeve itself.

Other embodiments include varying the number of layers, materials used, number, location and configuration of handles; and types and location of fastening devices to secure the layers together. An insulating plug can also be designed and used to seal ducts. For example, insulating plugs could be designed for insertion in place of an air filter when the ducts are only used for air conditioning and not heat. Or, the insulating plug can be designed for insertion into a chimney.

Although several embodiments described above and by the claims serve to illustrate various concepts, components and techniques which are the subject of this patent, it is apparent to those of ordinary skill in the art that other embodiments incorporating these concepts, components and techniques may be used. It is understood that the scope of the following claims are not limited to the described embodiments and that many modifications and embodiments are intended to be included within the scope of the following claims. In addition the specific terms utilized in the disclosure and claims are used in a generic and descriptive sense and not for the purpose of limiting the invention described in the following claims.

The invention claimed is:

1. An insulating plug designed for insertion into one of an air conditioning sleeve, a duct or a chimney comprising:

two flat, rectangular outer shell layers;

a minimum of 1 flat, solid rectangular layer of insulation in parallel with and extending substantially across an entire flat surface of each of said outer shell layers;

and a minimum of 1 flat, solid rectangular layer of gasket in parallel with and extending across an entire flat surface of each of the layer of insulation and with the outer shell layers wherein the insulation and gasket layers are located between the outer shells with all layers and shells fastened together;

wherein the gasket layer extends beyond an entire perimeter of the outside edges of the outer shells and is designed to contact the interior surface of one of an air conditioning sleeve, a duct or a chimney; and a minimum of 2 handles on at least one of the outer shells designed to be used for placing and straightening the plug inside one of an air conditioning sleeve, a duct or a chimney.

2. An insulating plug according to claim 1 wherein 1 layer of insulation is embedded in each outer shell.

3. An insulating plug according to claim 1 in which there are a minimum of 2 layers of gaskets between the outer shells.

4. An insulating plug according to claim 1 further comprising indentations on each outer shell for insertion of fastening devices.

5. An insulating plug according to claim 4 in which grommets and plungers are used as fastening devices.

6. An insulating plug according to claim 1 in which the gasket and insulation layers extend beyond the outside edges of both outer shells.

7. An insulating plug according to claim 6 wherein the outer shells are plastic.

8. An insulating plug according to claim 6 wherein the insulating layer is foam.

9. An insulating plug according to claim 6 wherein the gasket is foam.

10. An insulating plug according to claim 1 wherein the handles are fused to the outer shells.

11. A method for sealing an opening comprising two flat, rectangular outer shell layers;

a minimum of 1 flat, solid rectangular layer of insulation in parallel with and extending substantially across an entire flat surface of each of said outer shell layers;

and a minimum of 1 flat, solid rectangular layer of gasket in parallel with and extending across an entire flat surface of each of the layer of insulation and with the outer shell layers wherein the insulation and gasket layers are located between the outer shells with all layers and shells fastened together;

wherein the gasket layer extends beyond an entire perimeter of the outside edges of the outer shells and is designed to contact the interior surface of one of an air conditioning sleeve, a duct or a chimney; and a minimum of 2 handles on at least one of the outer shells designed to be used for placing and straightening the plug inside one of an air conditioning sleeve, a duct or a chimney;

creating an insulating plug tilting the insulating plug at a diagonal angle to the opening;

inserting the insulating plug into the opening;

straightening the plug to be essentially perpendicular to walls of the opening; and running fingers around the gasket to fill any air gaps between the gasket and walls of the opening.

12. A method according to claim 11 wherein the opening is an air conditioning sleeve.

13. An insulating plug according to claim 11 wherein the insulating plug is designed for insertion into a duct.

14. An insulating plug according to claim 11 wherein the insulating plug is designed for insertion into a chimney.

* * * * *